US006151130A

United States Patent [19]

Liguori et al.

[11] Patent Number: 6,151,130

[45] Date of Patent: Nov. 21, 2000

[54] PRINT PRODUCT ON DEMAND

[75] Inventors: Thomas A. Liguori, Poway; Robert T. Jennings, San Diego, both of Calif.

[73] Assignee: TLCD Corp., San Diego, Calif.

[21] Appl. No.: 09/114,933

[22] Filed: Jul. 14, 1998

[51] Int. Cl.[7] ..... B41B 17/00

[52] U.S. Cl. ..... 358/1.12; 101/5; 101/8; 156/238; 156/240; 156/541

[58] Field of Search ..... 358/1.9, 1.16, 358/1.15, 1.14; 101/8, 5, 93, 228; 156/238, 240, 541

[56] References Cited

U.S. PATENT DOCUMENTS

| | | | |
|---|---|---|---|
| 3,584,574 | 6/1971 | Smith et al. | 101/93 |
| 4,028,118 | 6/1977 | Nakasuji et al. | 106/21 |
| 4,207,365 | 6/1980 | Hamisch, Jr. | 428/40 |
| 4,334,471 | 6/1982 | Noyes et al. | 101/228 |
| 4,354,851 | 10/1982 | Hix et al. | 8/471 |
| 4,502,381 | 3/1985 | Liguori | 101/40 |
| 4,758,952 | 7/1988 | Harris, Jr. et al. | 364/300 |
| 4,893,555 | 1/1990 | Leyland et al. | 101/29 |
| 4,973,374 | 11/1990 | Karlyn | 156/238 |
| 5,244,529 | 9/1993 | Siegel | 156/384 |
| 5,247,314 | 9/1993 | Stephenson | 346/76 |
| 5,248,363 | 9/1993 | Hale | 156/230 |
| 5,379,056 | 1/1995 | Walter et al. | 346/76 |
| 5,464,729 | 11/1995 | Hoebener et al. | 430/396 |
| 5,527,407 | 6/1996 | Gartland et al. | 156/64 |
| 5,555,813 | 9/1996 | Hale et al. | 101/492 |
| 5,576,264 | 11/1996 | Ueno et al. | 503/227 |
| 5,594,484 | 1/1997 | Furukawa | 347/95 |
| 5,598,202 | 1/1997 | Peterson | 367/213 |
| 5,642,141 | 6/1997 | Hale et al. | 347/3 |
| 5,643,387 | 7/1997 | Berghauser et al. | 156/230 |
| 5,677,043 | 10/1997 | Hultman et al. | 428/212 |
| 5,725,935 | 3/1998 | Rajan | 428/195 |

*Primary Examiner*—David K. Moore
*Assistant Examiner*—King Y. Poon
*Attorney, Agent, or Firm*—Pillsbury Madison & Sutro LLP

[57] ABSTRACT

A process and apparatus for placing printed color images on a series of objects, by: generating digital data representing a plurality of different color images; providing a print medium composed of a substrate carrying a coating which is releasable from the substrate and is formulated to retain printing inks; providing a digitally controlled color printer having a plurality of print heads; supplying the generated digital data to the printer; feeding the print medium through the printer and past the print heads while operating the print heads under control of the generated data to print the color images on the coating; and placing a portion of the coating on which an image has been printed in contact with one of the objects and transferring the image to the object.

12 Claims, 2 Drawing Sheets

PRINT PRODUCT ON DEMAND

BACKGROUND OF THE INVENTION

The present invention relates to a process and apparatus for placing printed images, particularly printed color images, on objects having a variety of sizes and shapes.

It is known in the art to apply printed color images to various objects, including bottles, various other types of packages, writing instruments, etc., by first printing such images on release coats provided on support films, including polyester films, and then transferring the images to the final object. The processes and equipment currently employed for this purpose, typically of the offset or rotogravure type, can be operated economically only in those cases where a very large number of identical images are to be printed. This is true because very high set-up costs are associated with the creation of each image.

Typically, in the prior art, an image is separated into four basic process colors, such as cyan, magenta, yellow and black. A negative is created for each color and a photosensitive printing plate is developed for each negative. Once the four printing plates have been mounted on a press, they are inked and a press "make-ready" registration process is performed. Frequently, this operation itself takes several hours. As a result, it has not been considered economically feasible to use such a process to produce fewer than 20,000 copies of the same image.

In view of these economic limitations, when a given design, or image, is to be produced in small numbers, it is the typical practice to employ silk screening. However, silk screening requires the use of multiple screens to produce images composed of a plurality of colors and care must be taken to properly position, or register, each screen on the object to which the image is to be applied.

BRIEF SUMMARY OF THE INVENTION

It is a primary object of the present invention to print a succession of images and transfer the images to objects in a more flexible and economical manner than has heretofore been possible.

A more specific object of the invention is to print different transfer images, each possibly with individually selected text, in any sequence in an economical manner.

A further object of the invention is to produce a sequence of transfer images on a common substrate which allows efficient transfer of each image to a selected object.

Yet another object of the invention is to print transfer images on an elongated web which is supplied to printing apparatus in the form of a roll and which is then wound into a roll after passing through the printing apparatus.

The above and other objects are achieved, according to the invention by a process and apparatus for placing printed color images on a series of objects by the steps of:

generating digital data representing each color image;

providing a print medium composed of a substrate carrying a coating which is releasable from the substrate and is formulated to retain printing inks;

providing a digitally controlled color printer having a plurality of print heads;

supplying the generated digital data to the printer;

feeding the print medium through the printer and past the print heads while the print heads are operated under control of the generated data to print the color images on the coating, and rolling the print medium into a roll after printing; and placing a portion of the coating on which an image has been printed in contact with an object and transferring the image to the object.

DETAILED DESCRIPTION OF THE INVENTION

The present invention utilizes digital image processing technology and digitally controlled color printing technology in a novel combination and configuration to make possible, for the first time, the printing of any desired combination of transfer images on a printing medium web.

Figure 1:
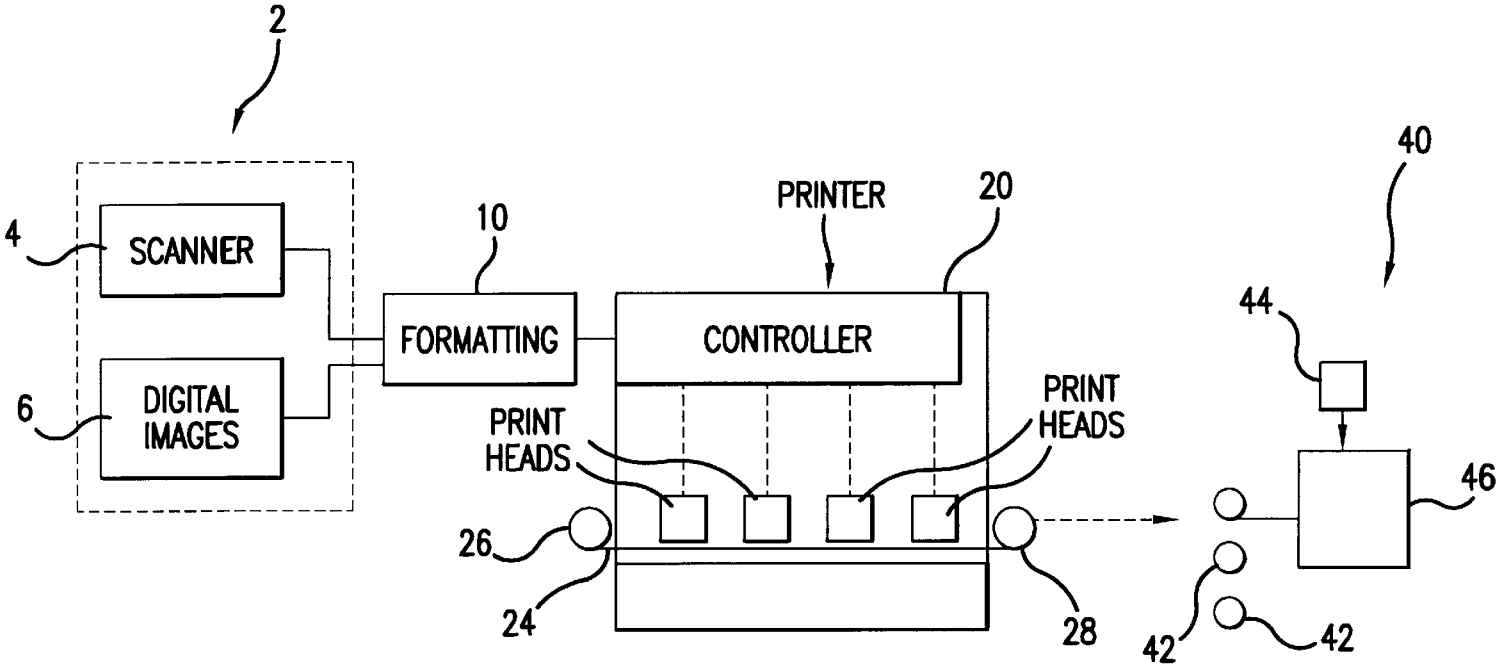
FIG. 1 is a simplified pictorial view of one preferred embodiment of apparatus in accordance with the present invention.

One preferred arrangement for achieving the objects of the present invention is illustrated in FIG. 1. The illustrated system includes an image generating station 2 where digital data representing selected images are generated. By way of example, image generating station 2 may include a scanner 4 and a memory 6 containing digital image data derived from any external source. It will be understood that station 2 can consist of other sources of digital image data including a computer terminal connected to receive such data from remote locations including, but not limited to, internet sites.

All of the data for images to be printed are supplied to a formatting station 10 which will perform a variety of tasks. Specifically, in station 10, each image will be formatted to the desired size. In addition, data representing each image will be associated with position data designating the location at which the image is to be printed on a print medium. Depending on image size, a number of images can be placed side-by-side on the printing medium, to form several parallel columns of images, as well as being distributed along the length of the medium.

After data representing a plurality of images has thus been formatted and associated with position data, the combined data can be transferred to the controller of a digitally controlled color printer 20 which is capable of performing full color printing on a print medium in the form of a long web.

Printer 20 includes four print heads, each for printing black or a respective primary color in order to produce full color prints. Printer 20 is further equipped to receive an elongated print medium web 24 initially supplied to printer 20 in the form of a roll 26. Web 24 is unwound from roll 26 and fed through printer 20, passing each print head in succession. The image data may initially be in any commonly used graphic format, a typical example being a Post Script™ format. The data processing system associated with the printer may be of a type which utilizes bit map images and is preferably constructed to directly receive bit map images from any one of the image sources or to convert images in other formats, such as Post Script™ formats, into bit map image files.

A suitable printer would be a DCP series printer marketed under the tradename XEIKON™ by Xeikon America, Inc. The DCP printer cited above can be controlled by existing software such as the Digital Imaging System marketed by Prime Source Corporation and packaged with DCP printers. This software includes a first subsystem termed a Raster Image Processor which translates postscript information into bitmap image files, and a second subsystem termed a Print Engine Supervisor which stores the bitmap files and manages printing conditions within the printer engine. The Raster Image Processor includes Harlequin Script Works software. Operating personnel can interface with the Print Engine Supervisor with the aid of a Windows program entitled Xpose to perform job management functions. Xeikon also has available a front end application program known as the Variable Data System which can be used to produce print jobs with variable data. Print data for controlling color printing of web 24 in a DCP series printer can be entered and formatted using the above-described software and operating instructions supplied therewith by the software publisher.

Figure 1A:
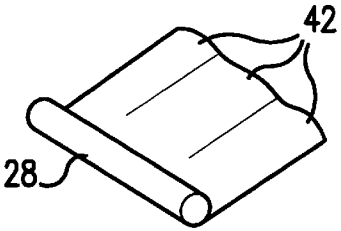
FIG. 1A is a pictorial view illustrating an operating step performed in connection with operation of the apparatus of FIG. 1.

After having been printed, web 24 is wound into a take-up roll 28 and after the entire length of the web 24 has thus been printed, it can be delivered, for example manually, to an image transfer station 40. Depending on the needs and capacity of station 40, roll 28 may be cut lengthwise into a plurality of strips 42, as illustrated in FIG. 1A. Each strip 42 carries one column of images and may be formed into a roll for delivery to station 40. Station 40 also includes a source 44 of objects to which the printed images are to be transferred.

Station 40 may include, for example, a known high-speed hot stamping machine 46 which is equipped to bring each object to which a print is to be transferred into position relative to an associated image on web 24, after which appropriate heat and pressure are applied to transfer the image to the object.

The printed images can be transferred to virtually any type of object made of a material to which the ink forming the images will adhere. A wide range of plastics, including polystyrene, polyester, etc., will satisfy this requirement. Objects to which images may be transferred include writing instruments or parts thereof, key cases, any type of bottles, etc. These specific objects are cited only by way of example, it being understood that images can be transferred to virtually any manufactured object.

Figure 2:
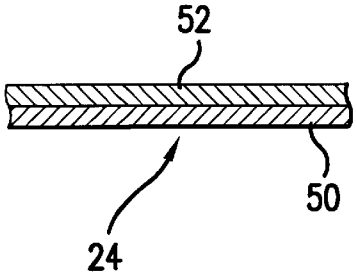
FIG. 2 is a cross-sectional detail view of a portion of a print medium utilized in the practice of the present invention.

To perform the printing and image transfer operations described above, it is necessary to provide a specially constructed web 24 which is capable of being wound into a roll and receiving printed images in a manner which allows subsequent transfer of those images to surfaces of objects. For this purpose, web 24 may be composed, as shown in FIG. 2, of a suitable plastic substrate 50 provided with a special release coating 52 that is capable of retaining printing ink and of being easily separated from substrate 50. By way of example, substrate 50 may be made of Mylar® and coating 52 may be a release coating which is formulated to retain a printed image until the coating is applied against an object with sufficient heat and pressure to transfer the image and the coating to the object. This will assure that images are not prematurely transferred from the coating when print medium 24 is wound onto roll 28.

As should be self-evident, print medium 24 would be fed through printer 20 with release coating 52 facing the print heads and would be fed through machine 46 so that coating 52 comes in contact with the object to which a printed image is to be transferred.

One material which may be employed as substrate 50 is a 75 gauge polyester film, which can be obtained from many sources.

Coating 52 may be based on an acrylic polymer modified with additives to enhance release from polyester film 50 and adherence to the target surface of the object. The additives employed may include melamine or urea-formaldehyde resins, microcrystalline waxes, acetylenic diols, plasticizers, solvents, etc. Coating 52 may be produced from a solvent based formulation or an emulsion based formulation. The former will generally be applied in the form of a continuous film, while the latter will take the form of a discontinuous film which is converted into a continuous film as a result of coalescense of the emulsion particles under heat and pressure during the stamping process. The following are exemplary formulations for each coating type.

1. Solvent Based:

| | |
|---|---|
| Acrylic Resin Solution in Mineral Spirits | 80.0% |
| Mineral Spirits | 12.0% |
| Microcrystalline wax | 8.0% |

2. Emulsion Based:

| | |
|---|---|
| Styrene acrylic emulsion | 55.0% |
| Ammonium Zirconium Carbonate Solution | 13.0% |
| Sodium Polyacrylate Solution | 4.0% |
| Polyoxyethylene Glycols | 0.5% |
| Microcrystalline wax | 10.0% |
| Deionized water | 9.5% |
| Isopropyl alcohol | 8.0% |

According to preferred embodiments of the invention, the acrylic resin of the solvent-based composition is isobutyl methacrylate and/or butyl methacrylate polymer, and the styrene acrylic emulsion of the emulsion-based composition is an emulsion copolymer of styrene and 2-ethyl hexyl acrylate and/or butyl acrylate. Other formulations known to be suitable for use as release coats capable of receiving printed images may be used.

Either type of coating may be suitably applied to a Mylar® or other polyester substrate by, for example, a continuous web flexographic process or by other known techniques. After application, the coating will be dried under time and temperature conditions suitable for the vehicles employed.

Image data may be obtained simultaneously from a plurality of, i.e., two or more, image sources. Each source may be a scanner, a computer, etc.

According to preferred embodiments of the invention, data from a plurality of sources 4, 6 is processed and formatted so that the data from each source produces images in a respective column on web 24, each column extending in the direction of the length of the web and the plural columns being spaced apart in the direction of the width of the web. After printing, web 24 may be slit lengthwise into a plurality of strips 42, each carrying one column of images, as shown in FIG. 1A.

The hot stamping machine may be a commercially available machine, for example a Harvey roll-on deco machine, preferably a single head model HFR-100 or a double head model HFRO-200. In addition, machines of this type are disclosed in U.S. Pat. No. 4,502,381. These machines are marketed by the Harvey Machine co. of Nashville, Tenn.

Another suitable hot stamper may be the PRECO™ automatic film transfer roll stamper machine, model KS-65. This machine is manufactured by the Preco company of Osaka, Japan.

Figure 3:
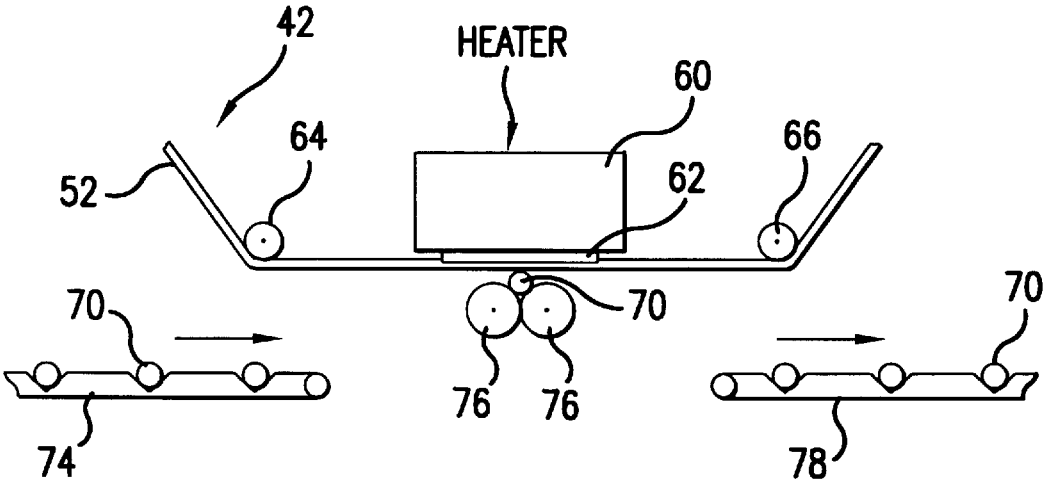
FIG. 3 is a pictorial, side-elevational detail view of a portion of the interior of a first embodiment of a stamper employed as a component of a system according to the invention.
Figure 4:
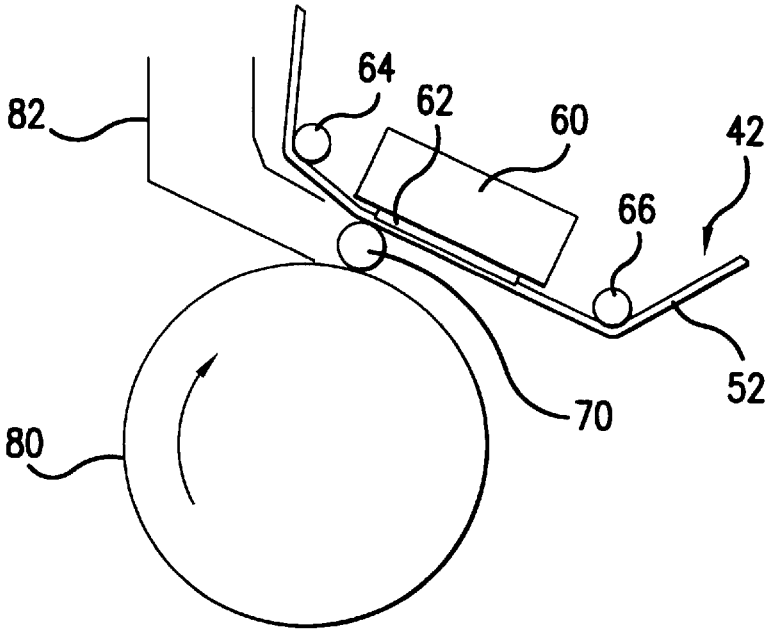
FIG. 4 is a view similar to that of FIG. 3 of another embodiment of a stamper employed as a component of a system according to the invention.

FIGS. 3 and 4 show the basic components of respective ones of the two above-cited Harvey machines.

The interior of the hot stamping machine depicted in FIG. 3 includes a heater 60 which carries, at its lower surface, a heated die 62 that may be made of a silicone material. A selected web strip 42 is fed through the machine by being guided around two rollers 64 and 66 so as to slide against die 62. Strip 42 is oriented so that coating 52 faces downwardly. A succession of objects 70 upon which images are to be transferred is conveyed by a first toothed conveyor 74. Each object 70 is conveyed in turn to a transfer position where it is supported by two pressure rollers 76. In the illustrated example, each object 70 has the form of a circular cylinder and may be constituted, for example, by a pen or pen cap. Strip 42 is advanced along die 62 and halted at an indexed stamping position. Then, with strip 42 stationary relative to die 62, rollers 76 press object 70 against coating 52 and are displaced parallel to coating 52 while rollers 76 are allowed to rotate freely about their respective axes so that object 70 rolls about its longitudinal axis along coating 52 until the complete circumference of object 70 has made contact with strip 42. Thus, object 70 and coating 52 are maintained in non-sliding contact with one another while heat is applied by heater 60 and pressure is applied by rollers 76 in order to transfer a selected image to the peripheral surface of object 70. After such transfer, object 70 is withdrawn from the image transfer position and placed on a toothed exit conveyor 78.

The stamping machine is provided with suitable mechanisms for conveying each object 70 in turn from conveyor 74 to the transfer position where it is supported by rollers 76, and for subsequently conveying an object 70 to which an image has been transferred onto exit conveyor 78. Since this mechanism forms part of a known, commercially available stamping machine, and is thus not a novel feature of the present invention, it has not been illustrated or described herein. Conveyance of each object 70 to the transfer location is synchronized with the indexing movements of strip 42.

The basic components of a second embodiment of a known stamping which may be employed as a component of a system according to the present invention is illustrated in FIG. 4, where elements identical to those of FIG. 3 are identified with the same reference numerals. In the embodiment of FIG. 4, rollers 76 are replaced by a single, large-diameter roller 80 made of a relatively resilient material, for example, a silicon material, which will press each object 70 in turn against coating 52 of a selected portion of strip 42. Roller 80 is resiliently deformable to be able to press object 70 against coating 52 while rolling object 70 along the portion of coating 52 which carries an image that is to be transferred to object 70

Heater 60 and die 62 are tilted relative to the orientation shown in FIG. 3 so that a portion of strip 42 whose coating 52 carries a given transfer image is inclined to the horizontal. Strip 42 and roller 80 form a gap having a selected thickness. A plurality of objects 70 are stored in a hopper 82 which has an outlet located adjacent the more elevated, or leading, end of die 62. Hopper 82 is equipped with a suitable mechanism to dispense each object 70 in turn into the gap between strip 42 and roller 80.

For transferring an image to an object 70, strip 42 is advanced until the image to be transferred is accurately positioned on die 62 and strip 42 is halted. Then an object 70 is fed from hopper 82 in order descend under the effect of gravity into the gap between strip 42 and roller 80, at the location of the leading end of die 62. At the same time, roller 80 is rotating in the direction of the arrow so as to press object 70 against coating 52 and roll object 70 along the portion of coating 52 which is supported by die 62 and which carries the image to be transferred to object 70. During transfer of the image, object 70 rolls without sliding along coating 52. The pressure applied by roller 80 cooperates with the heat supplied by heater 60 via die 62 to effect transfer of an image from coating 52 to the peripheral surface of object 70. When object 70 has reached the lowermost, or trailing, end of die 62, image transfer will have been completed and object 70 falls under the influence of gravity into a collecting receptacle (not shown).

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. A process for placing printed color images on a series of objects, each object having a curved exterior solid outer surface, the process comprising the steps of:

generating digital data representing a plurality of color images and a location where the colors are to be printed to form the images for printing onto a print medium to form the plurality of color images;

providing a print medium composed of a flexible substrate, said substrate having first and second sides with the first side carrying a coating, said coating formed from an acrylic resin solution or a styrene acrylic emulsion, which is releasable from the substrate and is formulated to retain printing inks, wherein said print medium is constituted by an elongated web which is in the form of a roll;

providing a digitally controlled color printer having a plurality of print heads for dispensing printing inks of respectively different colors;

supplying the generated digital data to the printer where the digital data represents the color images and the location at which the colors of the images are to be printed onto the coating of the print medium;

feeding the print medium through the printer and past the print heads such that the web is unwound from the roll for feeding through the printer and wound back onto the roll after feeding through the printer and, simultaneously with said feeding step, operating the print heads under control of the generated data to directly print the color images on the coating;

arranging the images, depending on image size, to be placed side by side onto the coating of the print medium to form several parallel columns of images;

providing a transfer positioning conveyor for placing the objects to be printed onto pressure rollers;

moving a succession of the objects to be printed by the conveyor, one by one, onto said pressure rollers, said pressure rollers positioning the objects to be printed adjacent to the print medium;

placing a portion of the coating on which an image has been directly printed in contact with the object by the pressure rollers;

applying heat by means of a heater to the print medium, wherein the pressure rollers are disposed adjacent to the first side of the print medium and the heater is disposed adjacent to the second side of the print medium;

transferring the image to the curved surface of the object by rotating the object such that (i) the curved exterior outer surface of the object comes into rolling contact along the portion of the coating on which the image has been printed (ii) printing of the object begins and ends at predetermined times; and (iii) the object and coating are maintained in a non-sliding contact with one another; and providing exit conveyor means for moving the object after printing has been completed to a position away from the pressure rollers.

2. The process of claim 1 wherein said step of generating digital data is carried out to provide data representing a plurality of sets of color images and said step of operating the print heads is carried out to print the images in a plurality of columns, each column being composed of one respective set of color images and extending along the direction of movement of the print medium during said feeding step.

3. The process of claim 2 wherein each set of color images is generated by a respective one of a plurality of data sources.

4. The process of claim 1 wherein the printer provides a flat printing path along which the web is fed during said feeding step.

5. The process according to claim 1 wherein said steps of placing and transferring comprise pressing the object against the coating portion by means of rollers which advance the object relative to the web while maintaining the object in non-sliding contact with the coating.

6. Apparatus for placing printed color images on a series of objects, each object having a curved exterior solid outer surface, through the intermediary of a print medium composed of a substrate, said substrate having first and second sides with the first side carrying a coating, said coating formed from an acrylic resin solution or a styrene acrylic emulsion, which is releasable from the substrate and is formulated to retain printing inks, wherein said print medium is constituted by an elongated web in the form of a roll and wherein the images are arranged, depending on image size, side by side on the coating to form a plurality of parallel columns of images, said apparatus comprising:

means for generating digital data representing a plurality of color images and a location where the colors are to be printed to form the images;

a digitally controlled color printer having a plurality of print heads;

a printing controller connected to receive the digital data from said means for generating and for supplying printer control signals to said print heads;

means for feeding the print medium through the printer and past the print heads while operating the print heads under control of the printer control signals to print the color images on the coating such that the feeding step includes unwinding the web from the roll for feeding through the printer and winding the web back onto the roll after feeding through the printer;

transfer positioning conveyor for moving a succession of the objects to be printed, one by one, onto pressure rollers; said pressure rollers positioning the objects to be printed adjacent to the print medium, and placing a portion of the coating on which an image has been directly printed in contact with the object;

heater means for supplying heat to the print medium, wherein the pressure rollers are disposed adjacent to the first side of the print medium and the heater means is disposed adjacent to the second side of the print medium;

rotating means for rotating the object such that (i) the curved surface of the object comes into rolling contact along the portion of the coating on which the image has been printed; (ii) the printing of the object begins and ends at predetermined times; and (iii) the object and coating are maintained in a non-sliding contact with one another; and exit conveyor means for moving the object after printing has been completed to a position away from the pressure rollers.

7. The apparatus of claim 6 wherein said means for transferring images comprise a hot stamping machine.

8. The apparatus of claim 6 wherein said means for generating digital data is carried out to provide data representing a plurality of sets of color images and said step of operating the print heads is carried out to print the images in a plurality of columns, each column being composed of one respective set of color images and extending along the direction of movement of the print medium during said feeding step.

9. The apparatus of claim 8 wherein said means for generating digital data comprise a plurality of data sources each generating a respective one of the sets of color images.

10. The apparatus of claim 6 wherein the printer provides a flat printing path along which the web is fed during said feeding step.

11. The process of claim 1 wherein the curved surface of the object is cylindical.

12. A process for placing printed color images on a series of objects each having a curved exterior solid outer surface comprising the steps of:

generating digital data representing a plurality of color images and a location where the colors are to be printed to form the images for printing onto a print medium to form the plurality of color images;

providing a print medium in the form of a roll that is composed of a flexible substrate, having first and second sides with the first side carrying a coating, said coating formed from an acrylic resin solution or styrene acrylic emulsion, which is releasable from the substrate and is formulated to retain printing inks;

providing a digitally controlled color printer having a plurality of print heads for dispensing printing inks of respectively different colors;

supplying the generated digital data to the printer, where the digital data represents the color images and the location at which the colors of the images are to be printed onto the coating of the print medium;

feeding the print medium through the printer and past the print heads such that the flexible substrate is unwound from the roll for feeding through the printer and wound back onto the roll after feeding through the printer and, simultaneously with said feeding step, operating the print heads under control of the generated data to print the color images on the coating;

arranging the images, depending on image size, to be placed side by side into the coating of the print medium to form several parallel columns of images;

providing a positioning conveyor for placing the objects to be printed onto pressure rollers;

moving a succession of the objects to be printed, one by one, onto said pressure rollers, said pressure rollers positioning the objects to be printed adjacent to the print medium;

placing a portion of the coating on which an image has been printed in contact with the object by the pressure rollers;

applying heat by means of a heater to the print medium, wherein the pressure rollers are disposed adjacent to the first side of the print medium and the heater is disposed adjacent to the second side of the print medium;

directly transferring the image to the curved surface of the object by rotating the object so as to establish a linear region of contact between the portion of the coating and the object and moving the linear region continuously along the object for a predetermined time while preventing sliding contact between the portion of the coating and the curved exterior outer surface of the object until the object has been printed; and providing an exit conveyor means for moving the object after printing has been completed to a position away from the pressure rollers.

* * * * *